US010986861B2

(12) United States Patent
Kissling et al.

(10) Patent No.: US 10,986,861 B2
(45) Date of Patent: Apr. 27, 2021

(54) TUBE FILLING DEVICE AND METHOD

(71) Applicant: JT International SA, Geneva (CH)

(72) Inventors: Christian Kissling, Olten (CH); Peter Preisig, Herisau (CH); Stephen Meyer, Oberengstringen (CH)

(73) Assignee: JT International S.A.

( * ) Notice: Subject to any disclaimer, the term of this patent is extended or adjusted under 35 U.S.C. 154(b) by 1196 days.

(21) Appl. No.: 14/359,277

(22) PCT Filed: Nov. 23, 2012

(86) PCT No.: PCT/EP2012/073484
§ 371 (c)(1),
(2) Date: May 19, 2014

(87) PCT Pub. No.: WO2013/076254
PCT Pub. Date: May 30, 2013

(65) Prior Publication Data

US 2014/0261469 A1 Sep. 18, 2014

(30) Foreign Application Priority Data

Nov. 24, 2011 (EP) ..... 11190629

(51) Int. Cl.
*A24C 5/40* (2006.01)
*A24C 5/06* (2006.01)

(52) U.S. Cl.
CPC . *A24C 5/40* (2013.01); *A24C 5/06* (2013.01)

(58) Field of Classification Search
None
See application file for complete search history.

(56) References Cited

U.S. PATENT DOCUMENTS 2,030,061 A * 2/1936 Gracey ..... A24C 5/42 131/75
3,822,710 A * 7/1974 Bramhill ..... A24C 5/40 131/348
3,927,681 A * 12/1975 Bramhill ..... A24C 5/40 131/70

(Continued)

FOREIGN PATENT DOCUMENTS

DE 341921 C 10/1921
EP 0387040 A1 * 9/1990 ..... A24C 5/40

(Continued)

OTHER PUBLICATIONS

International Search Report for PCT/EP2012/073484, dated Oct. 4, 2013, six pages.

*Primary Examiner* — Phu H Nguyen
(74) *Attorney, Agent, or Firm* — Lerner, David, Littenberg, Krumholz & Mentlik, LLP

(57) ABSTRACT

A method of transferring a portion (12) of smokable material from a casing (11) into a smokable tube (202), the method comprising advancing at least one of the casing and the portion of smokable material toward the other to advance the casing and the portion into the tube by a first distance less than the length of the space within the tube, at least partially withdrawing the casing from the tube, while holding the portion in the tube, and further driving the tobacco portion into the tube, as well as a corresponding device.

22 Claims, 10 Drawing Sheets

(56) References Cited

U.S. PATENT DOCUMENTS

| | | | | |
|---|---|---|---|---|
| 4,572,216 | A * | 2/1986 | Josuttis | A24C 5/02 131/70 |
| 5,749,378 | A | 5/1998 | Ruppert et al. | |
| 6,739,343 | B1 | 5/2004 | Trinkies et al. | |

FOREIGN PATENT DOCUMENTS

| | | | | |
|---|---|---|---|---|
| EP | 0387040 | A1 | 9/1990 | |
| WO | WO 2004110187 | A2 * | 12/2004 | A24C 5/40 |

* cited by examiner

TUBE FILLING DEVICE AND METHOD

CROSS REFERENCE TO RELATED APPLICATIONS

The present application is a national stage application under 35 U.S.C. § 371 of International Application No. PCT/EP2012/073484, filed Nov. 23, 2012, published in English, which claims priority from European Patent Application No. 11190629.3, filed Nov. 24, 2011, all of which are incorporated by reference herein in their entireties.

The present invention relates to methods and devices for filling a cigarette tube with a pre-portioned amount of smokable material provided in a portion casing. In particular, the invention relates to methods and devices for improving the quality of a cigarette manufactured by filling a tube with a portion of tobacco from a portion casing.

As an alternative to buying pre-manufactured cigarettes, it is available to a user to buy loose hand rolling tobacco and cigarette papers in order to roll his own cigarettes by hand. As an alternative, it is possible to purchase ready-made cigarette tubes, which generally include a filter at a first end and an open second end, and loose tobacco and to fill the cigarette tubes with the tobacco, commonly known as make-your-own (MYO) cigarettes. An alternative to loose tobacco for making MYO cigarettes is to use tobacco, or other smokable material, which is pre-portioned in tubes or casings, which are not intended for smoking, and which may not be suitable for smoking. The casing generally holds a portion of tobacco for a single cigarette and the portion is of a diameter small enough to fit in a paper cigarette tube. This tobacco portion can then be transferred manually by a user from the portion casing to the cigarette tube.

The drawbacks associated with known tobacco rod transferring devices are that, due to friction forces between the portion and its casing, or between the portion and the paper of the paper tube to which it is being transferred, a sub-optimal distribution of tobacco can be found in the resulting cigarette. The friction forces can mean that the tobacco that is driven furthest into the cigarette tube, at a distal or filter end of the tobacco portion, is rarefied in comparison to that which travels less distance into the cigarette tube. Further, the end of the tobacco portion which is driven against to displace the portion into the tube can be over-compressed, as it is subject to the resistance of friction forces from the whole length of the tobacco portion. This can result in an uneven density of tobacco in the resulting manufactured cigarette, which can detract from the user experience, since the quality of the cigarette can vary within the length of a cigarette itself, and also between sequentially manufactured cigarettes.

In seeking to address the drawbacks of prior art systems and devices, the present invention provides a method of transferring a portion of smokable material from a casing into a smokable tube, the method comprising:

advancing at least one of the casing and the portion of smokable material toward the other to advance the casing and the portion into the tube by a first distance less than the length of the space within the tube;

at least partially withdrawing the casing from the tube, while holding the portion in the tube; and further driving the tobacco portion into the tube.

The method of the present invention provides a more even distribution of smokable material in the finished smokable article and thus improves its impression of quality and the experience of the user. Advancing at least one of the portion and the tube toward the other can comprise maintaining either one in a fixed position and moving the other, or moving both toward one another simultaneously.

The method may alternatively comprise:

advancing at least one of the casing and the portion of smokable material toward the other to advance the casing and the portion into the tube and to drive a distal end of the portion to a closed end of the tube;

at least partially withdrawing the casing from the tube, while holding the portion in the tube; and further driving the tobacco portion toward the tube to remove the cigarette tube from the casing.

The partial withdrawal of the casing can allow the open end of the tube and the portion to be supported and protected during any later steps in the process before the finished cigarette is released for use by a user, resulting in a more consistent and attractive end product.

The step of displacing the casing and the portion of smokable material into the smokable tube by a first distance may leave a gap between the portion and a closed end of the tube. This allows the portion to be transferred into the tube in multiple steps which can result in a more even distribution of smokable material in the tube. The first distance may be less than a longitudinal length of the portion to allow further multiple steps of insertion.

The first distance may be less than:

around nine tenths of the length of the portion; or around four fifths of the length of the portion; or around three-quarters of the length of the portion; or around half of the length of the portion; or around a quarter of the length of the portion; or around 10% of the length of the portion; or between any of the above ranges. Depending upon the density, friction and other properties of the tube, casing and smokable material, different degrees of insertion of the portion in the initial steps and extraction of the casing in subsequent steps can be advantageous to obtain the most suitable final distribution of smokable material in the tube.

Displacing the portion within the casing may be carried out by a portion driving member of a cigarette tube filling device. The casing may be engaged by a cigarette tube filling device to displace the casing. Using a device to carry out these steps can improve the consistency over a purely manual process.

The casing may comprise an adaptor arranged to be engaged by a cigarette tube filling device. Alternatively, cigarette tube filling device may be arranged to grip the casing directly. This enables the use of a device for the method to improve distribution of smokable material and consistency of the end product.

The device may comprise movable casing engagement means for engaging the casing such that the machine can displace the casing in a longitudinal manner. The casing engagement means may comprise clamping means.

Tube end adapter means may be provided at the open end of the smokable tube. These means can help to guide the portion into the tube and may also protect the end of the tube from damage from the portion or its casing as each enters the tube The tube end adapter may comprise flexible members, or a substantially frustro-conical member, or a plurality of converging members having first ends located outside the tube and at a larger diameter than the tube and second ends at or within the tube end.

The method may further comprise displacing the portion and the smokable tube by driving an end of the portion. This allows both parts of the product to be displaced by action of a single member.

The portion and the smokable tube may be displaced until the tube abuts an end stop. This helps to compress the smokable material more evenly throughout the tube in the end product.

The portion and the smokable tube may be displaced by driving against an end of the portion until the smokable tube is removed from an outer side of the casing. This combines removal of the tube from the casing with more even distribution of the smokable material to efficiently provide an end product with improved distribution of material in the tube.

The smokable tube may be held in place by a tube retaining part of a machine during withdrawal of the casing. The tube retaining part may comprise a tube retaining mechanism, which may be arranged to clamp the tube.

Once the portion is transferred into the tube, the casing may be partially withdrawn, such that a first part of the portion in the tube is not in the casing, a second part of the portion in the tube remains in the casing and a part of the tube covers an end part of the casing. This allows the casing to support at least the tube and optionally the end of the portion during the transfer process to result in an improved end product.

The portion may be driven against a closed end of the tube to remove the tube from the casing, resulting in improved distribution of smokable material in the tube.

The length of the portion prior to transfer to the cigarette tube may be greater than the length of the void within the cigarette tube. This allows for compression of the portion within the tube during the process so that the smokable material can be compressed to a desired length and consistency and evenness of distribution of the smokable material can be improved. The length of the portion may alternatively be the same length as the length of the void within the tube, or shorter than the length of the void in the tube to help to ensure that no smokable material protrudes from the end of the tube after the transfer process is complete.

The method may further comprise measuring a length of the smokable tube and calculating an optimal end position to which the end of the portion should be driven.

The method may further comprise:

after at least partially withdrawing the casing from the smokable tube while holding the portion in the tube, further driving both the casing and the portion toward the cigarette tube. This can aid in providing an improved distribution of smokable material in the tube.

The method may further comprise the step of:

withdrawing the casing from the cigarette tube after the step of further driving the casing and the portion toward the cigarette tube.

The portion may be held in a substantially fixed position relative to the tube while the casing is withdrawn.

The step of at least partially withdrawing the casing relative to the tube may comprises:

withdrawing the casing by a distance of up to around 30% of the length of the tube; or withdrawing the casing by a distance of between around 3% to around 30% of the length of the tube; or withdrawing the casing by a distance of between around 10% and 30% of the length of the tube; or withdrawing the casing by a distance of between around 10% and 25% of the length of the tube; or withdrawing the casing by a distance of between around 3% and 10% or 25% of the length of the tube. Use of these ranges can improve the distribution of smokable material in the tube for different types and densities of material in the tube.

The method may further comprise the step of driving the second transfer member against the end of the tobacco portion in the filled cigarette tube to finish the cigarette end.

The casing may be a separate part of a consumable comprising the smokable portion and the casing. This allows the casing to be provided to a user for use in a re-usable device.

A cigarette tube filling device may be arranged to carry out the methods described herein.

A tube filling device for transferring a portion of smokable material from a casing to a smokable tube is further provided, comprising:

a tube receiving portion for receiving a smokable tube to be filled;

portion displacement means for displacing the portion relative to the casing; and casing displacement means for engaging and displacing the casing.

The casing displacement means and the portion displacement means may be movable relative to one another. This allows the device to control, at least to some degree, relative movement of the casing and portion to result in a more consistent process.

The casing displacement means may be movable relative to the tube receiving area to allow the casing to be moved into the tube in a controlled manner.

The casing displacement means and the portion displacement means may be movable relative to one another and relative to the tube receiving portion to allow independent and/or combined movement of the two displacement means relative to the tube.

The casing displacement means may comprise casing engagement means to allow the casing to be engaged.

The casing engagement means may comprise clamping means.

The tube receiving area may comprise tube engagement means for engaging the tube to hold it in place during the portion transfer process.

The tube engagement means may comprise clamping means and/or an end stop.

The casing displacement means may be driven by a first drive mechanism and the portion displacement means may be driven by a second drive mechanism, such that each may be driven independently of the other. This can allow the two displacement means to be driven in accordance with methods of the present invention to result in improved end products as described above.

The portion displacement means may be arranged to actuate a casing engagement means of the casing displacement means. This allows the casing engagement means to be actuated without the need for further drive mechanisms or actuators.

Figure 1:
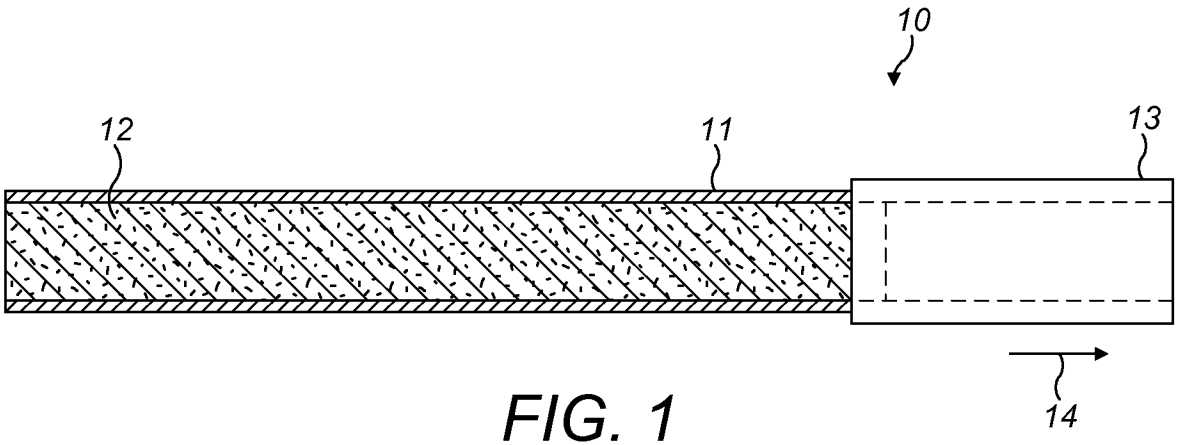
FIG. 1 shows an encased tobacco portion suitable for use in the device and methods of the present invention.

FIG. 1 shows a cased tobacco portion 10 suitable for use in the methods described herein. The product shown in the figure comprises a portion of smokable material 12, which may be tobacco or another smokable product. The smokable material of the portion 12 is encased in a casing 11. The casing of the example shown is of substantially cylindrical form and forms a hollow tube, the interior of which is filled with smokable material 12 and the smokable material 12 has a length and diameter approximately corresponding to those dimensions of the interior of a cigarette tube into which the portion of smokable material 12 is intended to be placed. This can be a standard paper cigarette tube as are well known in the manufacture of cigarettes, although generally in the mass manufacture of cigarettes, the paper is rolled around the tobacco portion in a high speed process, which is different from the methods of insertion of a tobacco portion into a pre-made tube described herein. The casing 11 has disposed at one end an adapter 13, which has a tubular form and is arranged as an extension of the casing 11 and has a hollow interior part. Although the embodiment shown and described has a substantially tubular adapter, an adapter could be any part of casing 11 arranged to be held or gripped by a user for manipulation of the casing, or the adapter may be further arranged for clamping or holding by a suitable part of a machine. It will therefore be apparent that a tubular form is not essential, the important aspect of adapter 13 is that it permits the casing 11 to be gripped and manipulated so that the casing can be moved, especially in a direction of the longitudinal axis of the tube forming casing 11.

With such an adapter in place, it is possible to use the adapter to place the portion 12 of smokable material inside a pre-formed cigarette tube, along with casing 11. By placing a portion driving element inside adapter 13 when casing 11 is withdrawn in a direction of arrow 14 in FIG. 1, the portion of smokable material 12 is held inside the cigarette tube, while the casing 11 is withdrawn. The portion driving element may be substantially cylindrical and may have a substantially circular end, such that the circular end corresponds approximately to the end profile of the portion 12, although any corresponding shape of portion and driving member may be suitable. These steps leave the user with a paper cigarette casing containing a portion of smokable material 12 and the empty casing 11 can then be disposed of or alternatively re-filled with a new portion 12 of smokable material for further use.

Known methods of carrying out the above described process for transferring a tobacco portion 12 into a cigarette tube are relatively simple, in that the portion 12 is inserted to its full extent to the distal end of a cigarette tube, and the casing 11 is withdrawn in a simple single step. Such simple processes can have numerous drawbacks. In particular, due to friction forces between the portion 12 and its casing 11, or between the portion 12 and the paper of the paper tube to which it is being transferred, distribution of the tobacco or other smokable material in the resulting cigarette can be uneven. The density of the resulting cigarette or other smokable product can vary along its length and this can lead to a sub-optimal and varied experience for the consumer as the resulting smokable item is smoked. The smokable material can be over-compressed at a first end, the first end being the end where pressure is applied by the driving member by pushing the smokable material or by simply holding it in place against friction forces as the casing 11 is withdrawn. The smokable material at the distal end of the portion, adjacent to the filter of the cigarette tube where the filter is present, can therefore be relatively rarefied compared to the end where pressure is applied. Certain distributions of tobacco within the tube may be preferred, for example in factory made cigarettes available to consumers, the tobacco within the cigarette may be more densely packed at one end to aid end-fortification of the cigarette and to prevent tobacco from falling from the cigarette during transport or use.

The methods described herein seek to address the drawbacks of such methods.

Figure 2A:
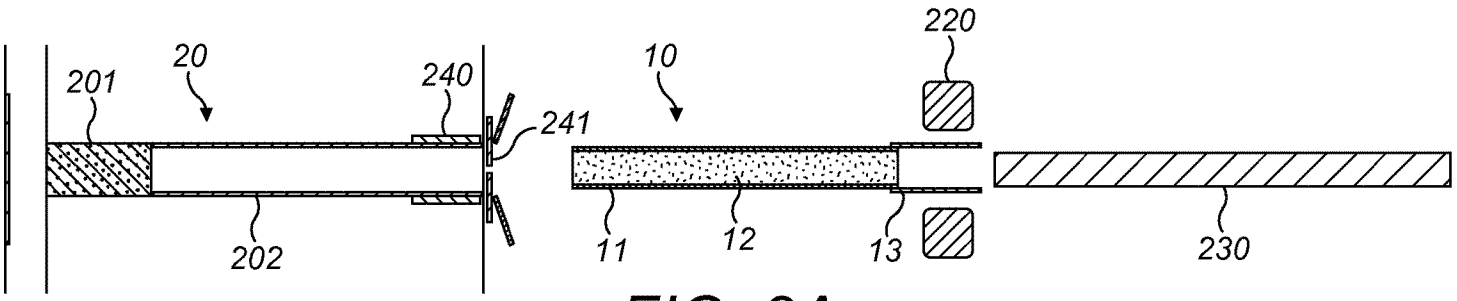
FIGS. 2A to 2C show schematic representations of a first method for transferring a tobacco portion from a casing to a cigarette tube.

FIG. 2A shows a schematic representation of a preliminary step in a method of the present invention. An empty cigarette tube 20 having a filter 201 and a tubular portion 202 is filled in a tube filling position. An encased tobacco portion 10 is located in longitudinal alignment with the tube 20 adjacent an open end of the tube 20. Casing engagement means 220 are located adjacent adapter 13 of casing 11 and a portion driving member 230 is arranged in longitudinal alignment with the axis of the cased portion 10 and the tube 20. There may be provided a series of flexible members 241 in the form of strips or flaps, which, upon insertion of casing 11 and portion 12 into the tube 202, are pushed into the tube and rotate about a base point corresponding approximately to the outer edge of tube 202, or corresponding to a point located radially just inside the diameter of tube 202. This has a dual function of protection the open end of tube 202 from damage as the casing 11 and portion 12 are inserted and also can assist in clamping the tube 202 against tube retaining means 240. Such an arrangement provides a tube end adapter for assisting the passage of the portion 12 and its casing 11 into the tube. Other tube end adapters may be contemplated, such as a substantially frustro-conical member having a first end of a diameter the same as or smaller than that of the cigarette tube and a second end of larger radius to assist in guiding the portion into the open tube end. A further tube end adapter means may be a pair or a plurality of converging members which have first ends located outside the tube and at a larger diameter than the tube and second ends at or within the tube end at a diameter the same as or smaller than the tube end, to guide the portion 12 into the tube. All such tube end adaptor means are optional and may be combined.

Figure 2B:
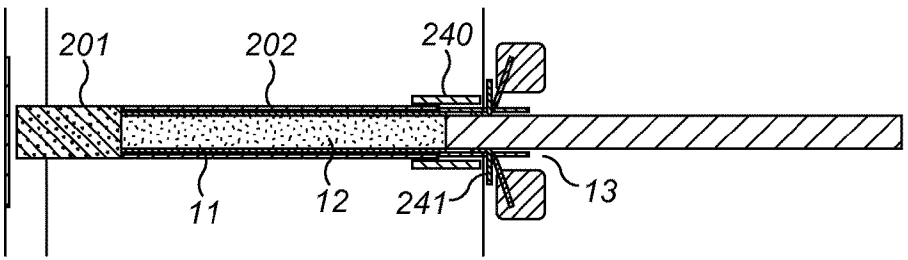

In FIG. 2B, the end of casing 11 and portion 12 has been advanced into cigarette tube 202. This advancing can be carried out by either or both of casing engagement means 220 and portion driving means 230. The initial advancing of the portion into the tube 202 may be partial, so that the portion does not reach the closed end of the cigarette tube at the filter end 201. Alternatively, it may, as shown in FIG. 2B, be a complete insertion, in that the portion 12 has been advanced, along with casing 11, substantially completely to the filter end of tube 202. In the step illustrated in FIG. 2B, the filled tube may be driven away from tube retaining means 240, the tube 202 can thus be disengaged from the flexible members 241 and tube retaining means 240, either completely or partially. If only partially, the tube 202 can then be completely disengaged when the tube is driven against end stop 241 in a further step described with regard to FIG. 2C.

Figure 2C:
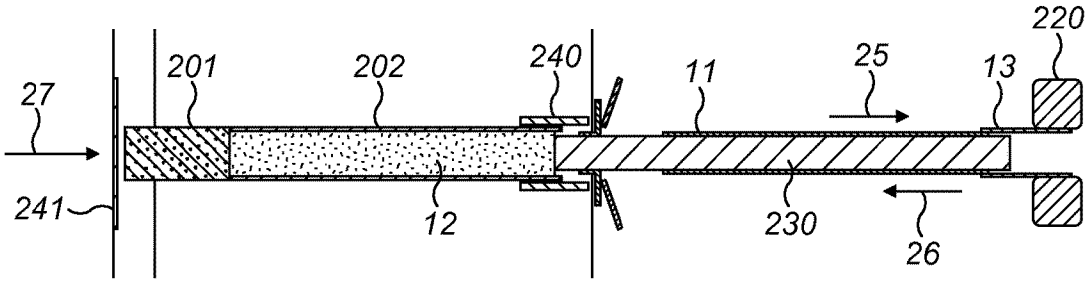

In FIG. 2C, casing engagement means 220 have been engaged with adapter 13 and the casing 11 has been withdrawn from the cigarette tube 202, leaving portion 12 in place, since portion 12 has been retained by portion driving means 230, to resist any friction between casing 11 and portion 12 as the casing 11 is withdrawn in the direction of arrow 25.

As is shown in FIGS. 2A, 2B and 2C, during some or all of the steps, cigarette tube 20 may be maintained in position by tube retaining means 240, which may hold the tube 202 in place, by adhesion, clamping, friction or any other suitable means, so that the tube is maintained in position during insertion of the portion 12 into tube 202 and extraction of the casing 11. Tube retaining means may additionally or alternatively be located adjacent the distal end of the tube 202, adjacent the filter 201 where present, for retaining the tube as the casing is extracted.

In a further step, which is not illustrated, the portion driving member 230 can be advanced further in the direction of arrow 26, which step can have two functions. Firstly, it can act to drive cigarette tube 202 away from tube retaining means 240 and can further drive the distal end 201, adjacent optional filter 201 of the filled cigarette against an end stop 241. This additional driving step against end stop 241 can result in a more even distribution of smokeable material 12 within the cigarette, since an opposing force at end stop 241 is created in the direction of arrow 27 and, since this force is substantially equal to the force applied by portion driving member 230, the compression of smokable material adjacent to filter 201 is substantially the same as at the end adjacent portion driving member 230 and throughout the portion 12, resulting in a more evenly distributed smokable material 12 within the finished cigarette, which results in a higher quality product, greater consistency between subsequent products made and an improved user experience.

Figure 3A:
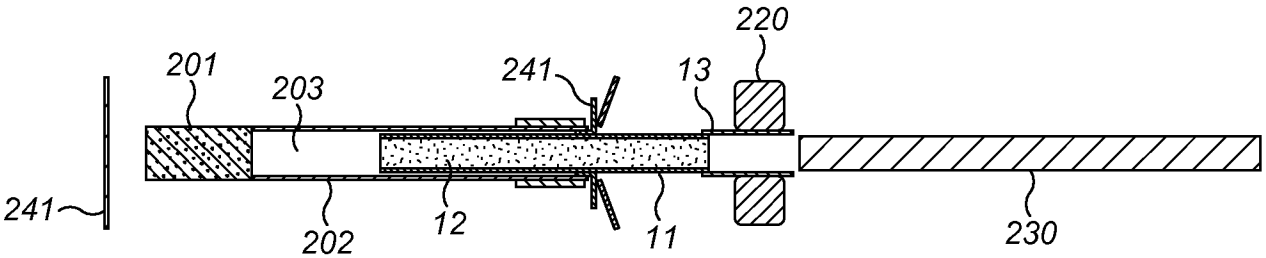
FIGS. 3A to 3E show schematic representations of a further method for transferring a tobacco portion from a casing to a cigarette tube.

FIG. 3A shows a schematic view of an initial insertion step of an alternative method. In FIGS. 3A to 3E, similar numerals are used for similar elements and so are not further described in detail in the following; their form and function in the following methods are substantially the same as for the preceding description. In the initial insertion step of 3A the casing 11 and portion 12 are partially inserted into cigarette tube 202. In this way, a gap 203 is left between the distal end of portion 12 and the distal end of tube 202, which is optionally closed by filter 201. In FIG. 2A, the casing 11 and the portion 12 have been advanced by the casing engagement means 220, but, as with the previous method, this initial step could be carried out by either or both of casing engagement means 220 or portion driving means 230.

Figure 3B:
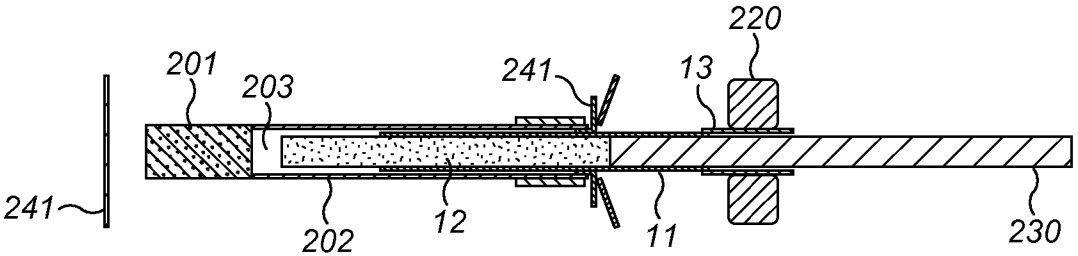

In FIG. 3B, portion driving means 230 drives the portion 12 further into cigarette tube 202, while casing engagement means 220 maintains casing 11 to prevent it from further advancing into the cigarette tube 202. In this way, the portion 12 is ejected from casing 11 within tube 202 by relative movement of casing 11 and portion 12. In this step, casing 11 could optionally be slightly further advanced from its initial position of FIG. 3A, however portion 12 is driven further into tube 202 than casing 11, in order to at least partially eject the portion from the casing.

Figure 3C:
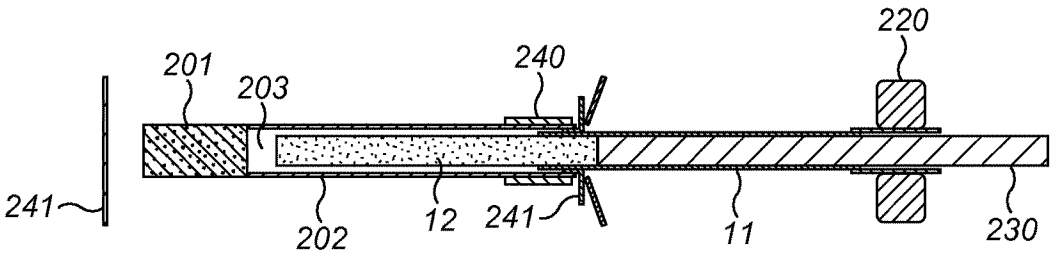

In the step illustrated in FIG. 3C, casing 11 is withdrawn from cigarette tube 202, while portion 12 is maintained within the cigarette tube by portion driving means 230. During withdrawal of casing 11, portion driving means 230 may continue to drive portion 12 further into tube 202, although this is optional. Gap 203 is still present in FIG. 3C, although reduced, since portion 12 has not yet been completely driven into cigarette tube 202 by portion driving means 230. The portion could alternatively be driven into the tube completely to eliminate the gap 230 at this step in the process.

The use of the partial insertion step before driving portion 12 further into cigarette tube 202 allows the degree of travel required by casing engagement means 220 to be reduced, while reducing any potential friction forces in the initial stages of the insertion stages between portion 12 and the tube 202, and can speed up the overall process, while providing a more evenly distributed cigarette as compared to previously known processes. Use of only partial insertion of the casing into the cigarette tube also helps to avoid any damage to the paper tube by collision with the adapter 13 of the casing 11. Further, the partial insertion of the casing allows the casing to be gripped along its length rather than by an adapter extending from an end of the casing and so this can remove the need for an adaptor 13 altogether if so desired, reducing costs associated with the adapter and can reduce the dimensions required for a machine to manipulate the casing due to its shorter overall length. The casing 11 is not completely extracted in FIG. 3C and is only partially extracted, so that a small portion of casing 11 remains within the end of cigarette tube 202. This is assists in stabilising the tube and portion 12 during the final steps of the operation as compared to the case where complete extraction of casing 11 is made at this stage. The only partial extraction of casing 11 can also result in an improved retention of tube 202 by flexible members 241 and tube retaining means 240 in the later steps of the process illustrated in FIGS. 3D and 3E.

Figure 3D:
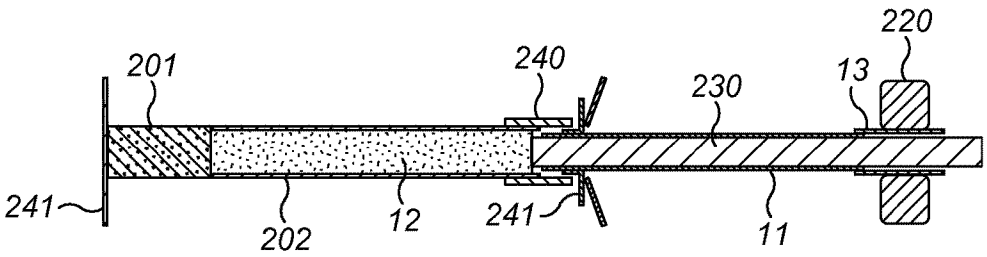

In FIG. 3D, portion driving means 230 is further advanced into cigarette tube 202 such that tube 202 is driven off the distal end of casing 11 and away from tube retaining means 240, to release the cigarette tube. In this step, the portion 12 may further be driven against end stop 241 which can again assist in evenly distributing the compression of the smokable material portion 12 within the finished cigarette as described with regard to FIG. 2C above. The only partial withdrawal of casing 11 provides better support to the open end of the tube and portion 12 during the final steps of the process and so results in a higher quality end to the finished cigarette at the open end of tube 202.

Figure 3E:
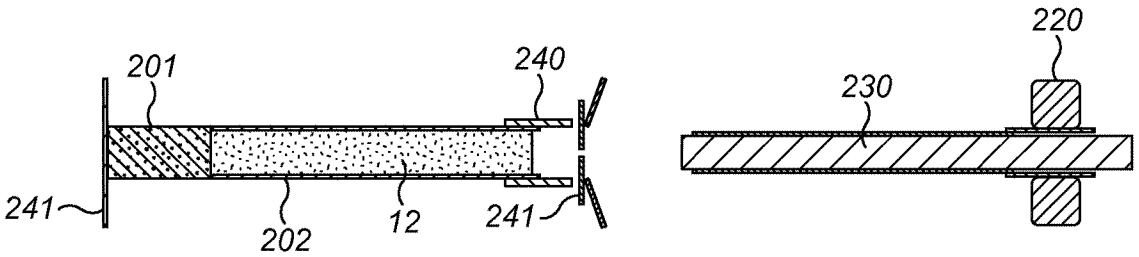

In the final step, illustrated in FIG. 3E, the portion driving means and casing engagement means 220 are withdrawn completely from the cigarette tube 202 to leave a finished cigarette.

After the final compression step of FIG. 3E against end stop 241, the portion 12 within the cigarette tube may relax back to a length slightly longer than its length immediately after the final compression step of FIG. 3D. There can therefore be contemplated two versions of the process described in FIGS. 3A to 3E. A first, in which at the step illustrated in FIG. 3D, the portion 12 is over compressed to a length less than is desired for the final cigarette. After the step of FIG. 3D, the portion may then relax back to a desired length of the final cigarette. In an alternative method, the portion 12 may be advanced in the step illustrated in FIG. 3D only to the point at which the length of the desired end cigarette is achieved. In this alternative, no relaxation of the portion 12 is expected and so after the step of FIG. 3D, the finished cigarette is complete and is manufactured to its desired length. This alternative may be implemented with a portion 12 which can be considered dimensionally stable in its longitudinal direction to avoid variations and inaccuracies in the final length and appearance of the finished cigarette.

The portion 12 of smokable material may be chosen such that it is longer than the ultimate desired length of the finished cigarette, so that a degree of compression of the portion 12 by portion driving member 230 is always possible and this helps to ensure that the finished cigarette is never shorter than the desired length. If the portion 12 is longer than desired, then the compression of the portion 12 between end stop 241 and portion driving member 230 corrects the length to the final desired length of the finished cigarette.

A further alternative process can be envisaged where, prior to any of the insertion steps, a length of the cigarette tube 202 is measured. In a following step, the casing 11 and portion 12 are partially inserted into the cigarette tube 202 as illustrated in FIG. 3A. The portion 12 is driven into the tube 202 by the portion driving means 230. This driving step can either drive the portion directly to the end so that no gap 203 of FIG. 3A is present, or may alternatively leave a gap 203 by only partial driving of portion 12 further into tube 202. In the following step the casing 11 is extracted, and may only be partially extracted, as shown in FIG. 3C. For the corresponding step of FIG. 3D, the optimal final position of portion driving means 230 may be calculated based upon the measured length of cigarette tube 202, which was taken prior to, or optionally during, the filling process. This calculation of an optimal final position for a portion driving means 230 based upon a measured length of the tube to be filled can result in the most optimal correspondence of the final end dimension of the portion 12 as compared to the length of the tube 202 within which it is. This alternative method is of particular benefit where the portion 12 is not prone to axial relaxation to a length longer than its compressed length after the step of FIG. 3D. Further, it is preferable that the original length of portion 12 within casing 11 is chosen so that it is longer than the filling length, which is known as the length of tube 202 which is filled, to result in the accurate finished length of portion 12 within tube 202.

Figure 4:
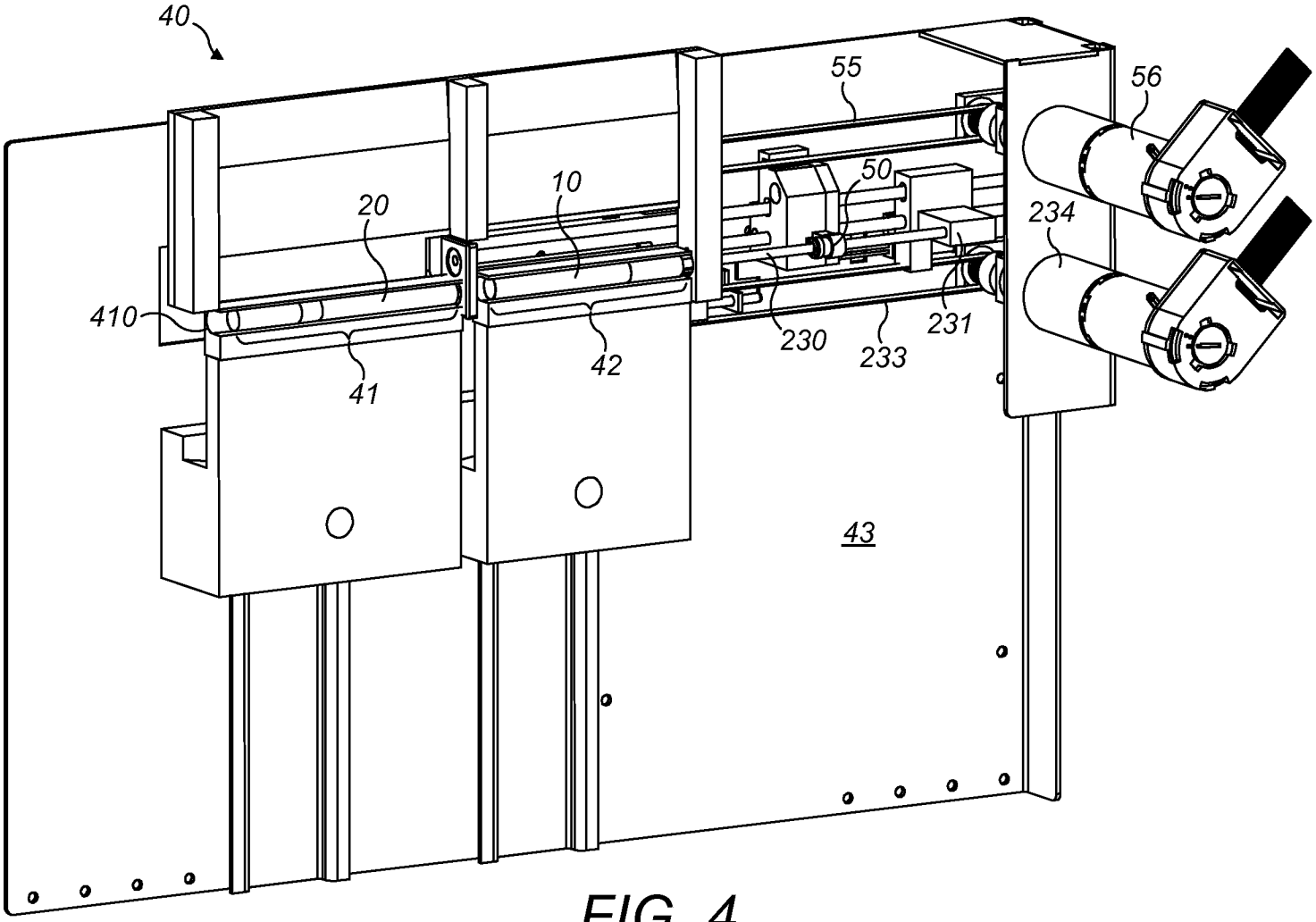
FIG. 4 shows an apparatus suitable for carrying out the methods of the present invention.

FIG. 4 shows a device 40 suitable for carrying out the methods of the present invention. The device has a cigarette tube receiving area 41 for receiving tube 20 to be filled and a portion receiving area 42 for receiving encased tobacco portion 10, comprising casing 11, which contains a portion 12 of smokable material to be transferred to the cigarette tube 20. The device has a chassis 43 to which various driving mechanisms and elements of the device are mounted. Cigarette tube 20 is maintained in a cigarette tube receiving area and is arranged in longitudinal alignment with encased tobacco portion 10. The device comprises a portion driving means 230, which is in the form of a bar or a shaft and which has a distal end which is configured to apply pressure to substantially the whole area of an end of portion 12 to drive the portion towards tube 20. The portion driving means 230 is in connection with a portion driving member transport means 231. This connection may be provided in the form of a clamp or bracket, or other suitable connecting means, which is attached to an end of portion driving means 230. The transport means 231 can be displaced by a number of means such as, for example, being mounted on a threaded bar and when the bar is rotated, the transport means can be displaced back and forth. Alternatively, the transport means could comprise a flexible drive band, such as a belt or a chain 233, and when the belt or chain is driven, by means such as a motor 234, this can impart a linear motion to the transport means 231, which is in turn passed to the driving member 230. Any appropriate drive means for imparting a linear motion to transport means 231 can be further envisaged, such as rack and pinion mechanisms or a cam and follower arrangement. Casing engagement means 50 are provided, and are shown in greater detail in FIG. 5B. The casing engagement means 50 are arranged to be driven by a linear drive 55, similar to that described with respect to the portion driving member transport means 231, so that when engaged with the casing 11, the casing 11 can be advanced or withdrawn in a substantially linear direction towards and away from cigarette tube 20 in tube receiving area 41. The components of the machine are mounted to the chassis 43 of the device, along with the driving means (55, 56; 233, 234) for the casing engagement means 50 and the portion driving member 230.

Tubes 20 and portions 10 may be supported in longitudinal channels in their respective receiving areas 41 and 42. An end stop may be located at a distal end 410 of the tube receiving area 41 to prevent the tube from moving longitudinally away from the casing during the portion transfer process beyond a certain point at which the end stop is located. The tubes 20 and portions 10 may be placed in their respective receiving areas manually by a user or moved there by a suitable mechanised arrangement, not shown in the Figures.

Figure 5A:
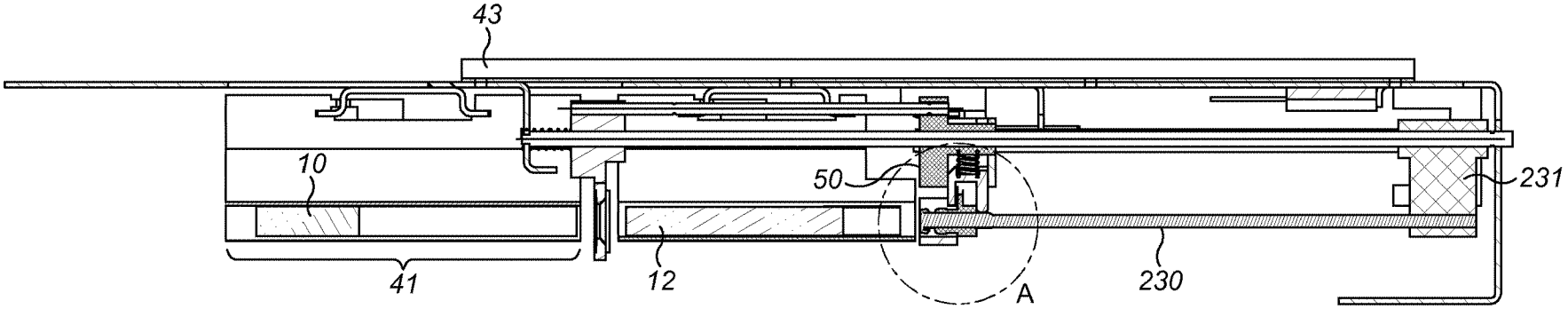
FIGS. 5A and 5B show further views of an apparatus for carrying out the methods of the present invention.

FIG. 5A shows the device of FIG. 4 viewed in section from above in an initial configuration, before the insertion steps of the previously described methods have begun. Cigarette tube 20 is maintained in cigarette tube receiving area 41 and is arranged in longitudinal alignment with encased tobacco portion 10 prior to the transfer process, either by manual presentation by a user or by appropriate displacement of the arrays 44, 45, to bring an appropriately prepared tube and portion into alignment with the portion driving means 230 and casing displacement means 50.

Figure 5B:
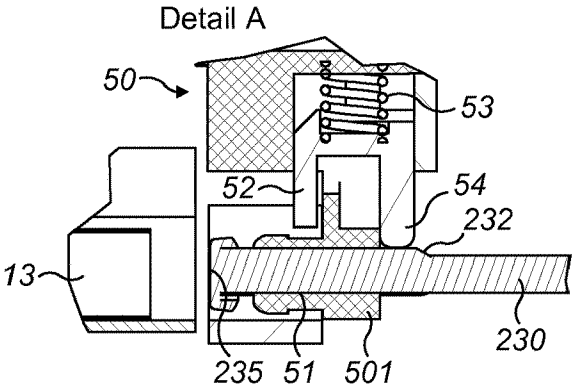

FIG. 5B shows an enlarged view of the device which engages with the casing 11 and portion 12 of the cased tobacco portion. The portion driving member 230 is configured to pass within adapter 13 without engaging the adapter, so that a substantially flat end 235 can impinge on an end of tobacco portion 12 within casing 11. A support member 501 is provided to guide the motion of the portion driving means 230 relative to the casing engagement means 50.

Casing engagement means 50 comprises a first member 51 which is arranged to pass to a first side of the adapter 13 of casing 11. In the case where the adapter is a tube, the first member 51 passes to the inside of the adapter tube 13. As can be seen in the figure, the first member 51 is connected to the support 501 which guides movement of the portion driving member 230. A second member 52 is arranged to engage the opposite side of the adapter 13 to the first member 51. In this way, when adapter 13 is placed between the first and second members 51 and 52 then the adapter can be clamped by those two members when they are moved towards one another. The first member 51 and second member 52 may be moved towards and away from one another by various actuating means, such as solenoids, piezoelectric device, screw threads and the like. In the example illustrated, the second member 52 is biased towards the first member 51 by biasing means 53, which may be any resilient member and in the illustrated embodiment is a coil spring. Movement of the second member towards and away from the first member is governed in the illustrated embodiment by a profiled section 232. The profiled section 232 comprises a part in which the side of portion driving member 230 transitions between first and second positions relative to the first member 51 of the casing engagement means 50. A follower member 54 is biased against the portion driving member 230, such that as the portion driving member is driven back and forth in a longitudinal direction, the follower member 54 follows the profile of an outside of the portion driving member 230. Since the second member 52 is connected with the follower member 54, when the follower member 54 advances towards member 51, as it reaches the appropriate part of the profiled section 232 of the portion driving member 230, and the second member 52 advances towards first member 51 to clamp the adapter 13.

Further alternative arrangements of casing engagement means can be envisaged, which include an expandable ring member which has a plurality of sections, the sections being displaceable radially relative to one another to exert outward radial forces on the inner side of the casing adapter 13. Alternative engagement or clamping forces may be created by members creating a radially inward force on the outer side of the adapter, or of the casing itself to engage the casing. These arrangements can avoid the need for clamping members to be placed both inside and outside the adaptor radius.

The portion driving member 230 therefore has a first part having a first lateral dimension for moving the casing engagement means to an open position and a second part having a second lateral dimension for allowing the casing engagement means to be moved into a clamped position on the adapter 13. A transition part may be provided between the first and second parts of the member 230. The device of the present invention may be therefore be configured so that relative motion of the portion driving member 230 relative to the casing engagement means 50 actuates a casing engagement mechanism (51, 52, 53, 54) of the casing engagement means.

Figure 6A:
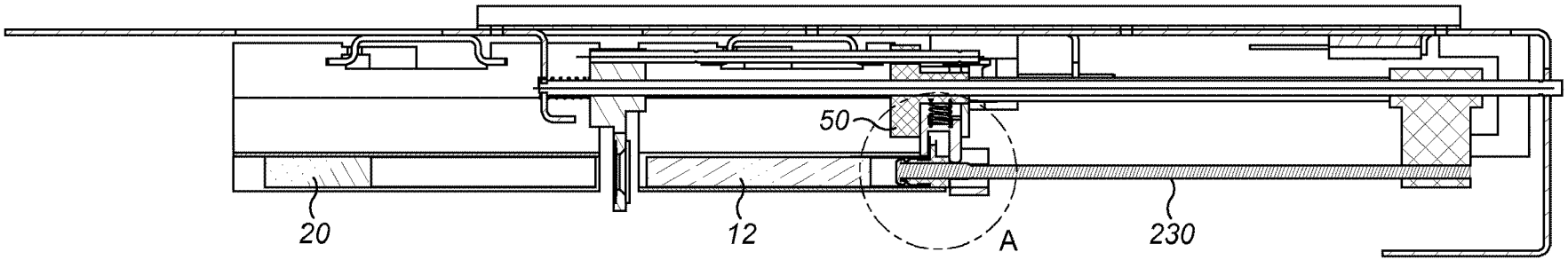
FIGS. 6A and 6B show the apparatus at one stage of operation carrying out methods of the present invention.
Figure 6B:
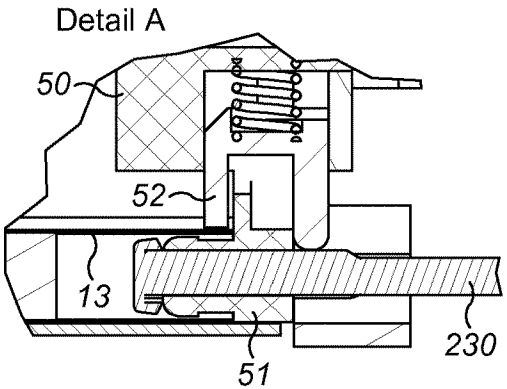

FIG. 6A illustrates a first step in certain methods of the present invention, in which the portion driving member 230 and the casing engagement means 50 have been advanced towards portion 12 and cigarette tube 20, such that the first member 51 of the casing engagement means 50 is adjacent to the adapter 13. In this particular embodiment, first member 51 is placed within the tubular adapter 13. FIG. 6B illustrates this configuration in greater detail. Since the portion driving member 230 and the casing engagement means 50 have been advanced by the same amount, their relative positions are maintained and the casing engagement means 50 is in an open position. First member 51 and second member 52 have not yet been advanced towards one another.

Figure 7A:
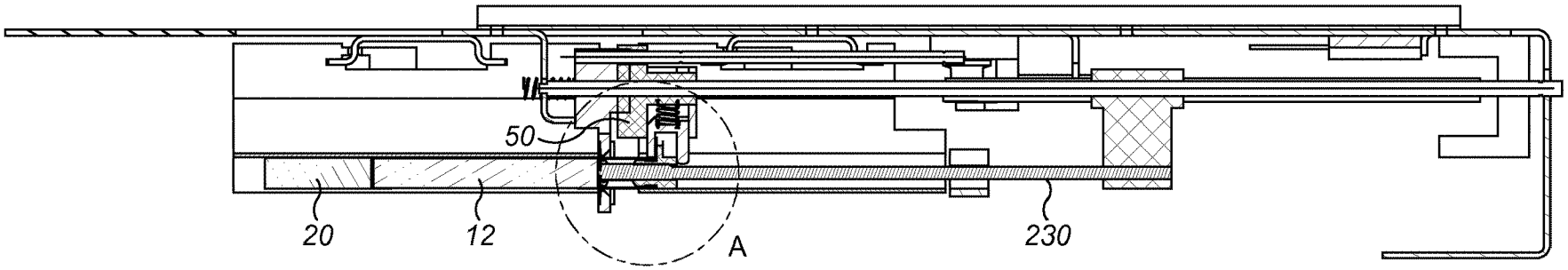
FIGS. 7A and 7B show the apparatus at a further stage carrying out methods of the present invention.
Figure 7B:
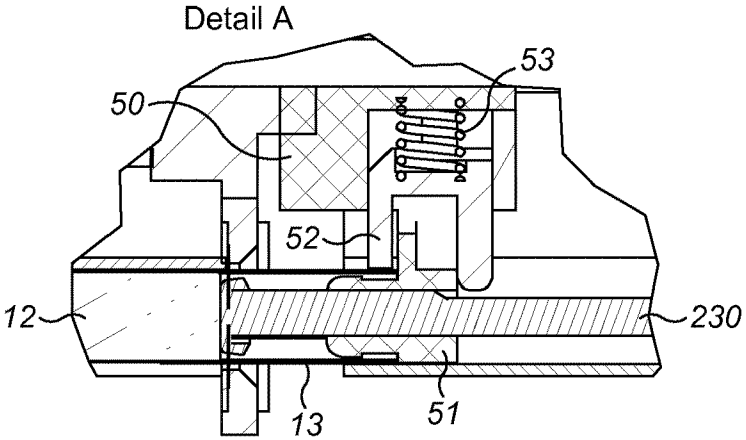

FIGS. 7A and 7B illustrate a further step in the operation. In this step, the casing engagement means 50 and the portion driving means 230 have both been advanced towards tube 20 to drive the portion 12 and its casing 11 into tube 20. This driving action may be by any complete or partial amount as described with regard to the methods set out in FIGS. 2A to 3E above.

As can be seen in FIG. 7B, the portion driving member 230 has been advanced relative to casing engagement means 50 so that the end portion driving member 230 is now adjacent and may be in contact with portion 12. Further, the follower member 54 of the casing engagement means 50 is now aligned with a part of the portion driving member 230 having a smaller lateral dimension. This results in follower member 54 being advanced in the direction of first member 51, so that second member 52 also advances towards first member 51 and the adapter 13 is clamped between members 51 and 52 by action of the biasing element 53.

Figure 8A:
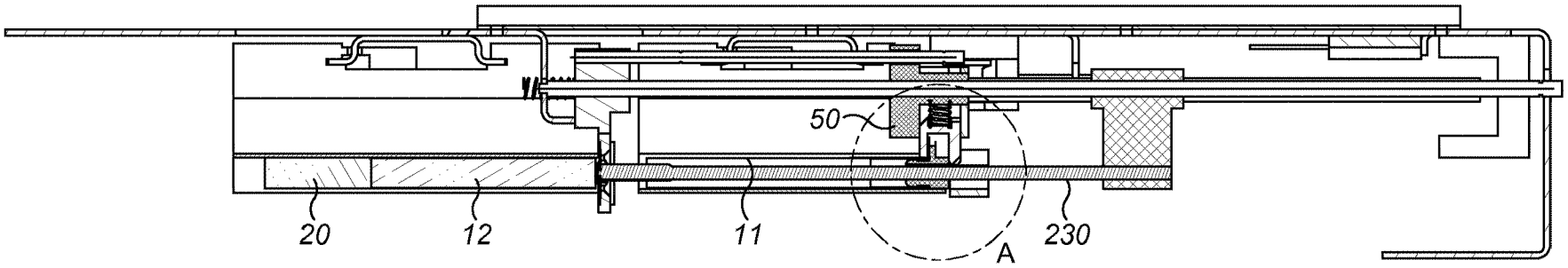
FIGS. 8A and 8B show the apparatus at a further stage in the methods of the present invention.
Figure 8B:
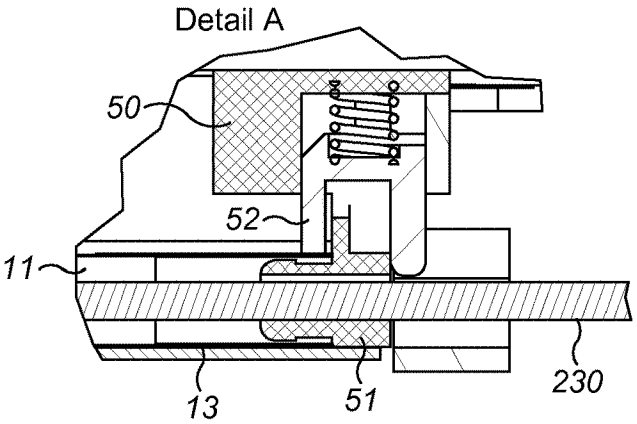

FIGS. 8A and 8B show the apparatus at a further step in a method of the present invention. Here it can be seen that the casing 11 has been withdrawn from tube 20 by movement of the casing engagement means 50 away from the cigarette tube 20. In the meantime, portion driving means 230 has been maintained in a fixed position relative to the tube to maintain portion 12 within the tube 20.

As can be seen in FIG. 8B, the casing engagement means 50 remains aligned with a part of portion driving member 230 which has a reduced lateral dimension so that the first and second members 51 and 52 remain in a clamped configuration on adapter 13 of casing 11.

Figure 9A:
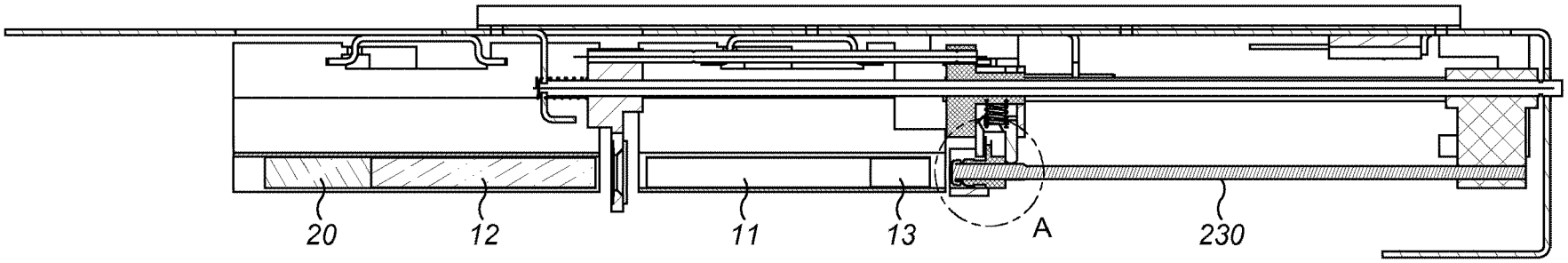
FIGS. 9A and 9B show the apparatus in a further stage of operation in the methods of the present invention.
Figure 9B:
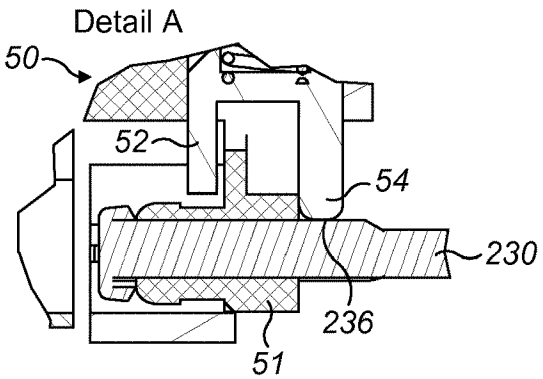

In FIGS. 9A and 9B, portion driving member 230 has been withdrawn from the tube 20 through casing 11 until the larger laterally dimensioned part 236 of the portion driving member 230 engages follower member 54. In this way, second member 52 is distanced from first member 51 of casing engagement means 50 and the adapter 13 of the casing 11 is therefore released and the casing engagement member can be moved away from adapter 13. Casing 11 and its adapter 13 are then free to be removed for either disposal or re-use.

It will be apparent that the apparatus described above can therefore be used to implement any of the tube filling methods described herein for transfer of a portion of smokable material 12 from a casing 11 to a cigarette tube 20. The different degrees of insertion of the portion 12 and casing 11 can be implemented by adapting the motion of the casing engagement means 50 and portion driving member transport means 231 accordingly via appropriate drive mechanisms and associated control systems. This motion could also be either partially or completely implemented by manual input to the respective transport means for the casing engagement means 50 and portion driving member 230.

The invention claimed is:

1. A method for producing a smoking article by transferring a portion of smokable material from a casing into a smokable tube using a tube filling device, the method comprising:

arranging a casing containing a portion of smokable material in longitudinal alignment with a smokable tube adjacent an open end of the smokable tube, the casing comprising an adaptor arranged to be engaged by a clamp of the tube filling device, the tube filling device including a portion driving member arranged in longitudinal alignment with the cased portion of smokable material portion and the smokable tube, using the portion driving member to insert the casing and the portion of smokable material into the smokable tube to drive a distal end of the portion of smokable material and a distal end of the casing to a closed end of the smokable tube;

at least partially withdrawing the casing from the smokable tube by engagement of the clamp with the adaptor such that the clamp can displace the casing in a longitudinal manner, while holding the portion of smokable material in the smokable tube with the portion driving member; and removing the casing from the smokable tube by further displacing the casing away from the smokable tube with the clamp engaged with the adaptor.

2. A method according to claim 1, wherein the casing is a separate part of a consumable comprising the portion of smokable material and the casing.

3. A method according to claim 1, wherein the step of using initially inserts the casing and the portion of smokable material into the smokable tube by a first distance and leaves a gap between the portion of smokable material and the closed end of the smokable tube.

4. A method according to claim 3, wherein the first distance is less than a longitudinal length of the portion of smokable material prior to insertion.

5. A method according to claim 4, wherein the first distance is less than:

around nine tenths of the length of the portion of smokable material; or around four fifths of the length of the portion of smokable material; or around three-quarters of the length of the portion of smokable material; or around half of the length of the portion of smokable material; or around a quarter of the length of the portion of smokable material; or around 10% of the length of the portion of smokable material.

6. A method according to claim 1, wherein tube end adapter means are provided at the open end of the smokable tube.

7. A method according to claim 6, wherein the tube end adapter means comprises flexible members.

8. A method according to claim 6, wherein the tube end adapter means comprises a substantially frustro-conical member.

9. A method according to claim 6, wherein the tube end adapter means comprises a plurality of converging members having first ends located outside the smokable tube and at a larger diameter than the smokable tube and second ends at or within the open end of the smokable tube.

10. A method according to claim 6, further comprising displacing the portion of smokable material and the smokable tube by driving an end of the portion of smokable material.

11. A method according to claim 10, wherein the portion of smokable material and the smokable tube are displaced until the smokable tube abuts an end stop.

12. A method according to claim 10, wherein the portion of smokable material and the smokable tube are displaced by driving against an end of the portion of smokable material until the smokable tube is removed from an outer side of the casing.

13. A method according to claim 12, wherein the smokable tube is held in place by a tube retaining part of a machine during withdrawal of the casing.

14. A method according to claim 13, wherein:

once the portion of smokable material is transferred into the smokable tube, the casing is partially withdrawn, such that a first part of the portion of smokable material in the smokable tube is not in the casing, a second part of the portion of smokable material in the smokable tube remains in the casing and a part of the smokable tube covers an end part of the casing.

15. A method according to claim 14, wherein the portion of smokable material is driven against the closed end of the smokable tube to remove the smokable tube from the casing.

16. A method according to claim 15, wherein the length of the portion of smokable material prior to transfer to the smokable tube is greater than a length of a void within the smokable tube.

17. A method according to claim 16, wherein:

a length of the smokable tube is measured; and an optimal end position to which the end of the portion of smokable material should be driven is calculated.

18. A method according to claim 17, further comprising:

after the step of at least partially withdrawing the casing from the smokable tube, while holding the portion of smokable material in the smokable tube, further driving both the casing and the portion of smokable material toward the smokable tube.

19. A method according to claim 18, further comprising the step of:

withdrawing the casing from the smokable tube after the step of further driving the casing and the portion of smokable material toward the smokable tube.

20. A method according to claim 19, wherein the portion of smokable material is held in a substantially fixed position relative to the smokable tube while the casing is withdrawn.

21. A method according to claim 20, wherein the step of at least partially withdrawing the casing relative to the smokable tube comprises:

withdrawing the casing by a distance of up to around 30% of the length of the smokable tube; or withdrawing the casing by a distance of between around 3% to around 30% of the length of the smokable tube; or withdrawing the casing by a distance of between around 10% and 30% of the length of the smokable tube; or withdrawing the casing by a distance of between around 10% and 25% of the length of the smokable tube; or withdrawing the casing by a distance of between around 3% and 10% or 25% of the length of the smokable tube.

22. A method according to claim 1, wherein the step of at least partially withdrawing the casing from the smokable tube, while holding the portion of smokable material in the smokable tube, includes holding the portion of smokable material in the smokable tube from the open end of the smokable tube.

* * * * *